US006397430B1

(12) United States Patent
Brown et al.

(10) Patent No.: US 6,397,430 B1
(45) Date of Patent: Jun. 4, 2002

(54) ADJUSTABLE HYDRAULIC BACKCHECK DOOR CLOSER

(75) Inventors: Peter E. Brown, Shropshire (GB); George F. Toledo, Fallbrook, CA (US)

(73) Assignee: Jackson Corporation, Los Angeles, CA (US)

( * ) Notice: Subject to any disclaimer, the term of this patent is extended or adjusted under 35 U.S.C. 154(b) by 0 days.

(21) Appl. No.: 09/519,567

(22) Filed: Mar. 6, 2000

(51) Int. Cl.[7] ..... E05F 3/00

(52) U.S. Cl. ..... 16/71; 16/51; 16/58; 16/66; 16/84

(58) Field of Search ..... 16/71, 72, 51, 16/52, 53, 49, 50, 65, 84

(56) References Cited

U.S. PATENT DOCUMENTS 3,246,362 A * 4/1966 Jackson
3,675,270 A * 7/1972 Jentsch ..... 16/53
3,724,023 A * 4/1973 Tillmann ..... 16/53
4,064,589 A * 12/1977 Bejarano et al.
4,658,468 A * 4/1987 Tillmann et al. ..... 16/53
5,050,268 A * 9/1991 Toledo ..... 16/53
5,651,162 A * 7/1997 Keszthelyi ..... 16/51
5,666,692 A * 9/1997 Toledo
5,738,250 A * 4/1998 Gillingham et al. ... 222/153.13
5,829,097 A * 11/1998 Toledo ..... 16/53

* cited by examiner

*Primary Examiner*—Lynne H. Browne
*Assistant Examiner*—Doug Hutton
(74) *Attorney, Agent, or Firm*—Sonnenschein Nath & Rosenthal

(57) ABSTRACT

A hydraulic backcheck valve system for controlling an opening cycle of a door closer has a housing with an interior chamber, at least one cylinder, and a piston that can reciprocate between a door closing stroke and a door opening stroke within the cylinder. One side of the piston faces a variable volume chamber in the cylinder and an opposite side of the piston faces the interior chamber of the housing. The backcheck valve system has a fluid passage with a port in fluid communication with the cylinder and an opening in fluid communication with the interior chamber of the housing. The port is blocked by the piston during at least part of the door opening stroke. A one-way valve is disposed in fluid communication with the fluid passage and permits fluid to flow freely during a closing cycle of the door closer and prevents fluid flow from the second passage during the opening cycle. A backcheck valve is disposed in fluid communication with the passage and with the variable volume chamber. The backcheck valve permits metered fluid flow from the second passage to the variable volume chamber during the opening cycle to control the opening cycle.

12 Claims, 2 Drawing Sheets

ADJUSTABLE HYDRAULIC BACKCHECK DOOR CLOSER

BACKGROUND OF THE INVENTION

1. Field of the Invention

The present invention generally relates to door closers, and more particularly to an adjustable hydraulic door closer wherein the opening cycle as well as the closing cycle of the door connected to the door closer can be fully controlled by manipulation of hydraulic fluid within the closer.

2. Description of the Related Art

A number of door closing mechanisms are available that both urge a door to a closed position, and slow the closing speed of the door to prevent the door from slamming into the door frame under force of the closing mechanism. Door closers are known for swinging doors having a spring actuated closing force with a hydraulic pot within the device that retards the closing speed. These closers have valve passage systems for passing hydraulic fluid in order to control the speed of door closing. Such door closers are disclosed in U.S. Pat. Nos. 4,064,589 and 3,246,362.

Some door closers have adjustable spring tension in order to increase or decrease the closing resistance or load provided by the door closer. An example of one such door closer is disclosed in U.S. Pat. No. 5,666,692.

SUMMARY OF THE INVENTION

One object of the present invention is to provide a door closer that has a compact and rugged structure. Another object of the present invention is to provide a door closer that utilizes a spring or springs mounted for compression within a housing of the closer. A further object of the present invention is to provide a door closer wherein the opening cycle of the door connected to the mechanism can be fully controlled. A still further object of the present is to provide a door closer wherein the closing cycle of the door that is connected to the closer can also be fully controlled. Another object of the present invention is to provide a door closer wherein the opening cycle control is accomplished by a novel arrangement of fluid passages and valves within the mechanism. An additional object of the present invention is to provide a door closer wherein the opening cycle is adjustable from an exterior of a closer. A still further object of the present invention is to provide a door closer wherein both the door opening and closing cycles are adjustable.

These and other objects, features and advantages of the present invention are achieved by a novel oil passageway arrangement within the door closer mechanism. In one embodiment, a hydraulic backcheck valve system for controlling an opening cycle of a door closer has a housing with an interior chamber, at least one cylinder, and a piston that can reciprocate between a door closing stroke and a door opening stroke within the cylinder. One side of the piston faces a variable volume chamber in the cylinder and an opposite side of the piston faces the interior chamber of the housing. The backcheck valve system has a fluid passage with a port in fluid communication with the cylinder and an opening in fluid communication with the interior chamber of the housing. The port is blocked by the piston during at least part of the door opening stroke. A one-way valve is disposed in fluid communication with the fluid passage and permits fluid to flow freely during a closing cycle of the door closer and prevents fluid flow from the second passage during the opening cycle. A backcheck valve is disposed in fluid communication with the passage and with the variable volume chamber. The backcheck valve permits metered fluid flow from the second passage to the variable volume chamber during the opening cycle to control the opening cycle.

In one embodiment, the port permits fluid to bypass the backcheck valve when the piston does not block the port during the opening cycle.

In one embodiment, the one-way valve assembly is a ball check valve assembly having a ball and a valve seat.

In one embodiment, the backcheck valve is an adjustable needle valve having a tool receiving head and a valve stem.

In one embodiment, the tool receiving head is accessible from an exterior of the housing to permit adjustment of the needle valve in order to vary a rate of the metered fluid flow for fluid that flows through the needle valve to adjust a resistance of the opening cycle.

In another embodiment of the invention, a door closer defining a door opening and a door closing cycle has a housing having an interior, at least one cylinder within the housing, and at least one piston that can reciprocate between a door closing stroke and a door opening stroke within the at least one cylinder. The at least one piston divides the interior into first and second chambers. A first passage is in fluid communication with the first chamber. A second passage has an opening in fluid communication with the second chamber and a second port in fluid communication with the at least one cylinder. The second port is blocked by the piston during at least part of the door opening stroke. A first one-way valve is in fluid communication with the first and the second passages. The one-way valve assembly permits fluid flow from the first passage to the second passage and prohibits fluid flow from the second passage to the first passage. A backcheck valve is in fluid communication with the first and the second passages and permits metered fluid flow from the second passage to the first passage. Fluid can bypass the backcheck valve through the port when the at least one piston does not block the port during the door opening stroke of the opening cycle.

In one embodiment, the door closer also has a biasing mechanism for biasing the at least one piston in a direction of the door closing stroke. In one embodiment, the biasing mechanism is a spring.

In one embodiment, the door closer also has a pair of the cylinders within the housing and a pair of the pistons, one each received in a corresponding one of the cylinders. A pair of the second ports each provide fluid communication between the second passage and a corresponding one of the cylinders.

In one embodiment, the first chamber is a variable volume chamber defined within the cylinder and faces one side of the at least one piston. The second chamber is an interior chamber of the housing and faces an opposite side of the pistons.

In one embodiment, the door closer also has a first port providing fluid communication between the first passage and the first chamber, and a third passage having a third port providing fluid communication between the third passage and the first chamber. The third port is positioned between the first and the second ports in the at least one cylinder. The third port is blocked by the at least one piston during at least part of the door closing stroke.

In one embodiment, the door closer also has a latch speed valve providing metered fluid flow between the first and the third passages when the third ports are blocked during the closing stroke, and a closing speed valve providing metered fluid flow between the first and the third passages when the third ports are not blocked during the closing stroke.

In one embodiment, the door closer also has a second one-way check valve disposed within the first passage between the closing speed valve and the latching speed valve. The second one-way check valve permits fluid flow from the closing speed valve to the latching speed valve within the first passage and prohibits fluid flow from the latching speed valve to the closing speed valve within the first passage.

In one embodiment, the second one-way check valve is a ball check valve with a valve seat and a ball. The ball is restrained in one direction of the first passage by the valve seat and in an opposite direction of the first passage by a valve stem of the latching speed valve.

In one embodiment, the backcheck valve is a needle valve with a valve stem and a tool receiving head on one end of the valve stem for receiving a tool that can adjust the metered flow rate of the backcheck valve. In one embodiment, the tool receiving head of the backcheck valve is accessible from an exterior surface of the housing.

In another embodiment of the invention, a one-way valve assembly has a fluid passage having opposed ends and a ball received in the fluid passage between the opposed ends. A valve seat is received in the fluid passage and is positioned to prevent movement of the ball toward one of the opposed ends. A valve stem of another valve assembly passes through the fluid passage, whereby the ball is prevented from moving toward the other of the opposed ends by the valve stem and is free to move within the fluid passage between the valve stem and the valve seat.

These and other objects, features and advantages of the present invention will become apparent upon reading the detailed description and accompanying drawing figures. Specific embodiments are described herein and are shown in the drawing figures. Changes and modifications can be made to the specific embodiments disclosed herein and yet fall within the scope of the present invention. The embodiments described and shown in the drawings are provided in order to illustrate the present invention and not in any way to limit the present invention.

DESCRIPTION OF THE PREFERRED EMBODIMENTS

Figure 1:
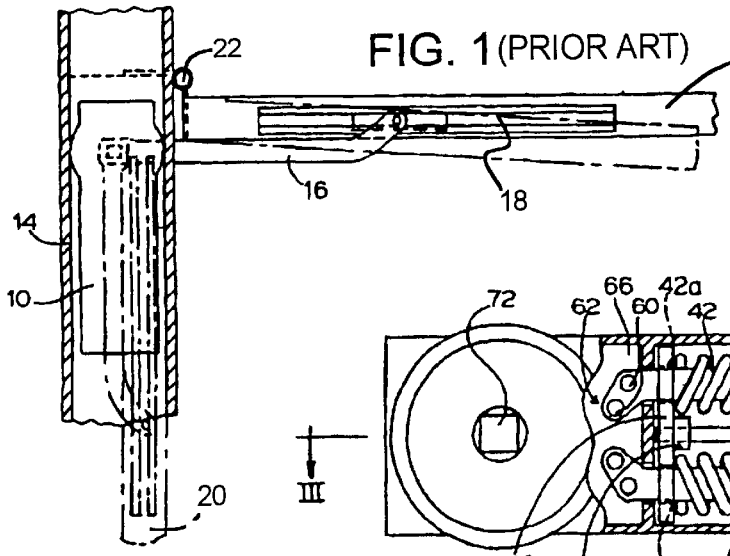
FIG. 1 (PRIOR ART)
FIG. 1 is a plan view of a door closer connected to a door and a door frame.
Figure 2:
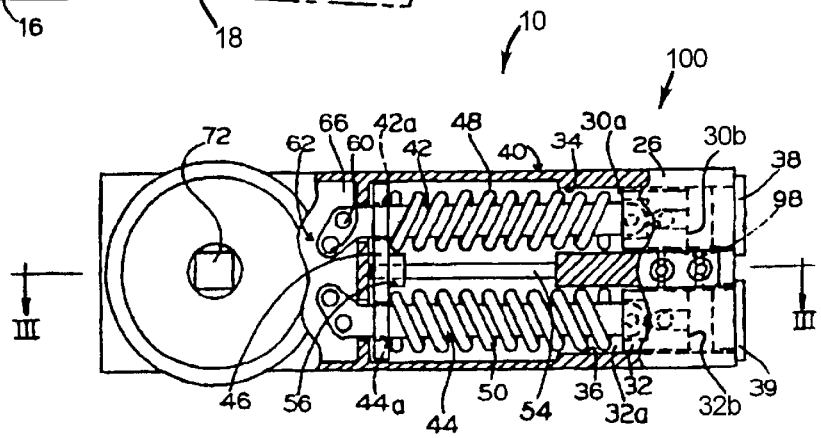
FIG. 2 (PRIOR ART)
FIG. 2 is a bottom view of the door closer of FIG. 1 with a portion of the cover plate removed to illustrate the general components of the closer mechanism.

FIGS. 1 and 2 generally illustrate a door closer mechanism for which the present invention is particularly useful. FIG. 1 illustrates a top plan view of a door closer 10 mounted in the transom above the door overhead or lintel 14 and connected by a closing lever 16 to a slide rail 18 that is mounted to a door 20. The door 20 pivots about hinges 22 from an open position as illustrated to a closed position shown in phantom view in FIG. 1. Alternately, the door closer 10 can be mounted to the door 20 and an appropriate lever structure can connect the door closer to a sliding attachment mounted to the door overhead or lintel, although this construction is not shown in the drawings.

FIG. 2 shows the door closer 10 in bottom view. A cover 26 is partially removed to expose the components within the closer. Two pistons 30 and 32 are closely confined within respective cylinders 34 and 36 within a cylinder head portion 100 of a housing 40 of the closer mechanism 10. The cylinders 34 and 36 are closed by caps 38 and 39 respectively. The pistons 30 and 32 are connected to reciprocable rods 42 and 44 respectively. The rods 42 and 44 pass through apertures 42*a* and 44*a* through a compression plate 46 which is movable within the housing 40. A first spring 48 and a second spring 50 are located between the compression plate 46 and the pistons 30 and 32, respectively. An adjusting screw 54 is connected to the compression plate 46 and when turned about its axis will move the compression plate longitudinally within the housing 40. By doing so, the spring tension can be altered in order to change the closing force characteristics.

The rods 42 and 44 are connected by screws 60 to a cam chassis 62 including a pair of cam plates 66 that are connected to and sandwich there between a cam (not shown) which is further connected to a spindle 72 extending downwardly through the housing 40.

Upon rotation of the spindle 72 by rotation of the door 20, the cam forces the chassis 62 to move longitudinally within the housing 40. The position illustrated in FIG. 2 corresponds to a door closed position. Upon rotation of the spindle 72, the chassis 62 moves in a direction A within the housing 40. This movement drives the pistons 30 and 32 in a door opening stroke within the housing 40 which further compresses the springs 48 and 50 against the compression plate.

When the pistons 30 and 32 are forced to the left in FIG. 2, oil or another viscous fluid that is held within the housing 40 is compressed by the movement of the pistons. The fluid under pressure is forced from backsides 30*a* and 32*a* of the pistons 30 and 32, respectively, through a series of valves and passageways, described in greater detail below, within the cylinders 34 and 36. Particular design details of the passageways and valves and the adjustment of the screw 54 can significantly alter the characteristics of the door closer in both the opening and closing cycles as described below. The general door closer described and illustrated in FIGS. 1 and 2 is provided herein for illustrating the present invention. The door closer construction can change considerably and yet fall within the scope of the present invention. Additionally, the adjustment screw 54 and compression plate 46 can be eliminated and yet the door closer can fall within the scope of the invention.

Figure 3:
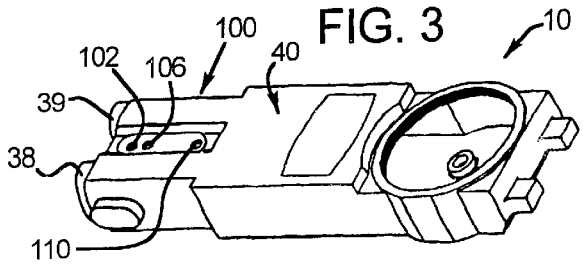
FIG. 3 is an elevational perspective view of a door closer mechanism constructed in accordance with one embodiment of the present invention.

FIG. 3 illustrates a perspective view of the door closer 10 showing the exterior housing 40 and the cylinder head 100 of the door closer carrying therein pistons 30 and 32. The caps 38 and 39 are illustrated in FIG. 3 and assist in coordinating between the general illustration of FIGS. 1–3 to the more particular illustration of FIGS. 4–7.

Figure 4:
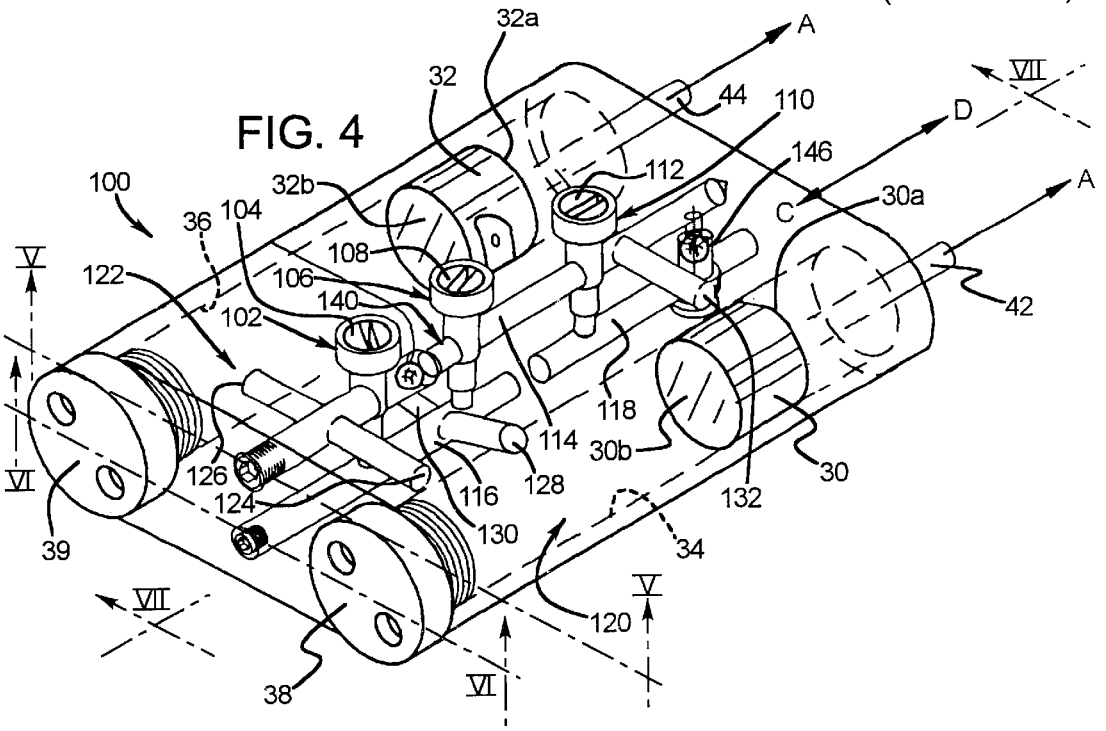
FIG. 4 is a perspective view of a portion of the mechanism shown in FIG. 3 with the exterior housing shown in phantom view to illustrate the interior fluid passageways and valves within the piston and cylinder head portion of the mechanism.

Referring now to FIG. 4, a system for controlling both the opening and closing cycles of a door closer are shown and described. The cylinder head portion 100 of the conventional door closer such as the door closer 10 is shown in FIG. 4 and illustrates the system of the present invention.

The system in general includes an adjustable latch speed valve 102, in the form of a needle valve, with a tool receiving head 104 for adjusting the valve as is known in the art. The system also includes a closing speed valve 106, in the form of a needle valve, that also includes a tool receiving head 108 for adjusting the valve. The system also incorporates a novel backcheck valve 110, in the form of a needle valve, that also includes an adjustable tool receiving head 112.

The system includes an upper first fluid passageway 114 having two blind ends and that communicates with the latch speed valve 102, the closing speed valve 106, and the hydraulic backcheck valve 110. The system also includes a lower second passageway 118 that includes a blind end disposed near the third lower passageway 116. The lower third passageway 116 also includes a pair of blind ends and communicates with each of the latch speed valve 102 and the closing speed valve 106. The other end of the second passageway 118 opens into an interior chamber 119 of the housing 40 that communicates with the undersides 30*a* and 32*a* of the pistons 30 and 32. The top ends 30*b* and 32*b* of the pistons 30 and 32 communicate with the cylinders 34 and 36, respectively, and face the caps 38 and 39 that close off the cylinders. The pistons 30 and 32 seal off the cylinders adjacent the top ends 30*b* and 32*b* and define variable volume chambers 120 and 122, respectively, between the top ends and the caps 38 and 39, respectively. The pistons 30 and 32 seal off the chambers 120 and 122 from the interior chamber 119 of the housing 40.

A pair of ports 124 and 126 extend radially outward from the first passageway 114 and provide fluid communication between the variable volume chambers 120 and 122, respectively, and the passageway 114. Another pair of ports 128 and 130 extend radially outward from the third passageway 116 into the cylinders 34 and 36, respectively, and provide fluid communication between the cylinders and the lower third passageway 116. Yet another pair of ports 132 and 134 extend radially outward from the upper first passageway 114 and also provide fluid communication between the first passageway and the cylinders 34 and 36, respectively.

The ports 124 and 126, hereinafter the first ports, are disposed near the ends of the cylinders 34 and 36, respectively, that are capped off by the caps 38 and 39. The ports 132 and 134, hereinafter the second ports, are disposed away from the first ports 124 and 126 and near the interior chamber of the housing 40. The ports 128 and 130, hereinafter the third ports, are disposed between the first and the second ports. The significance of the positioning of these ports will become apparent upon describing the particular function of the passageway system set forth below.

A first one-way valve in the form of a ball check valve assembly 146 communicates with and provides fluid communication between the lower second passageway 118 and the upper first passageway 114. The valve assembly 146 includes a ball 148 and valve seat 150 arranged so that fluid may flow freely from the upper first passageway 114 into the lower second passageway 118 and prevent flow in the opposite direction.

Figure 5:
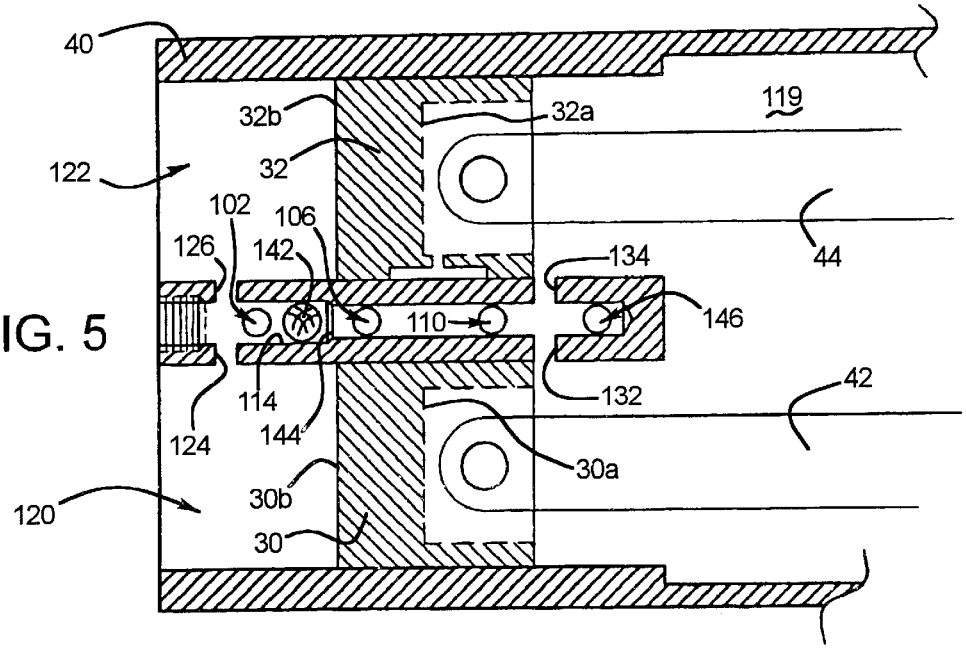
FIG. 5 is a cross sectional view taken along line V—V of the cylinder head of FIG. 4.
Figure 6:
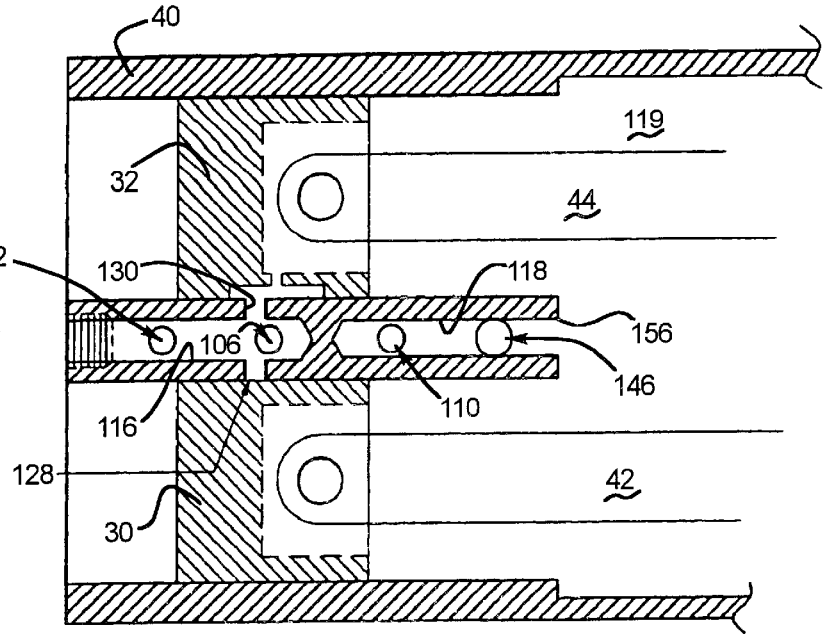
FIG. 6 is a cross sectional view taken along line VI—VI of the cylinder head of FIG. 4.
Figure 7:
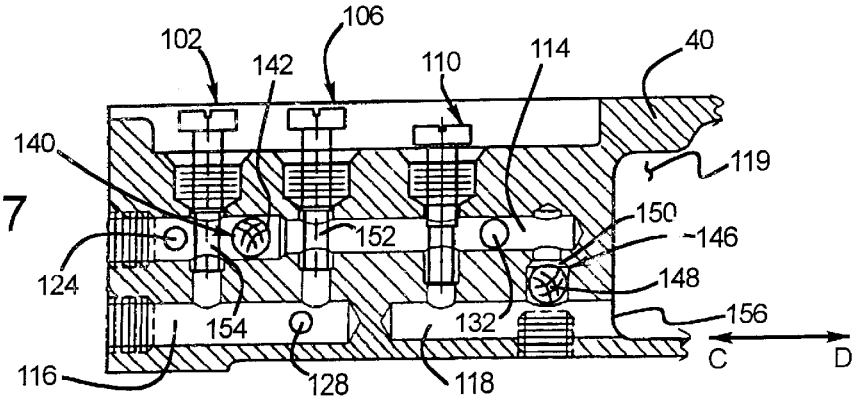
FIG. 7 illustrates a cross-sectional view taken along line VII—VII of the cylinder head of FIG. 4.

A second one-way valve in the form of a ball check valve assembly 140 is disposed between the latch speed valve 102 and the closing speed valve 106 within the upper passageway 114. The ball check valve 140 includes a ball 142 and a seat 144 as illustrated in FIG. 5 that permits fluid to flow freely in the direction from the closing speed valve 106 to the latch speed valve 102 and prevents fluid flow in the opposite direction.

As illustrated in FIG. 4, the pistons move in the direction of the arrow A, an opening stroke, when the door 20 is undergoing an opening cycle and being opened. In doing so, the springs 48 and 50 are compressed and held under compression until the door is closed. The pistons move in the opposite direction of the arrows A, a closing stroke, when the door closes. The entire variable volume chambers 120 and 122 and the interior, chamber 119 defined within the housing 40 on the bottom ends of the pistons 30*a* and 32*a* are completely filled with hydraulic fluid when the door closer 10 is assembled and functional. The function of the passageway system of passing fluid between the chambers will now be described.

As the door is opened, the pistons are drawn in the opening stroke in the direction of the arrows A by rotation of the spindle 72 and movement of the chassis 62 which pulls the piston rods 42 and 44 in the direction of the arrows A. Fluid is thus forced under pressure by the lower ends 30*a* and 32*a* of the pistons 30 and 32 to exit the interior chamber 119. The pistons 30 and 32 move away from the caps 38 and 39, respectively, and force the fluid within the interior chamber 119 of the housing 40 to find a path of least resistance for flow of the hydraulic oil. The fluid will therefore flow through the second ports 132 and 134 from the cylinders 34 and 36 and flow freely into the upper first passageway 114, around a valve stem 152 of the closing speed needle valve 106, through the open check valve assembly 140, beyond a stem 154 of the latch speed needle valve 102, and freely through the first ports 124 and 126 into the variable volume chambers 120 and 122, respectively. The pistons 30 and 32 eventually close off the second ports 132 and 134 as they continue to move. However, the pistons 30 and 32 will still continue moving in the opening stroke in the direction of the arrows A. The fluid within the interior of the housing 40 must then flow into an opening 156 of the second lower passageway 118 that communicates with the interior chamber 119. The check valve 146, as a one way valve, prevents flow from the second passageway 118 directly into the upper first passageway 114. Therefore, fluid flowing into the opening 156 must pass through the hydraulic backcheck valve 110 into the upper passageway 114. The adjustment of the back check valve 110 controls or meters the rate of fluid passage through the valve and therefore controls the rate of and resistance to opening the door. The fluid will flow through the backcheck valve 110 into the upper passageway 114, pass around the stem 152 of the valve 106, pass through the ball check valve assembly 140, pass around the stem 154 of the valve 102 and through the first ports 124 and 126 into the chambers 120 and 122, respectively. Once the second ports 132 and 134 are closed off by the pistons 30 and 32, the rate of resistance to opening of the door can be controlled by adjustment of the backcheck valve 110 utilizing the tool head 112. Particular placement of the second ports 132 and 134 and the size of the ports and the valve 110 can be designed to accommodate a particular desired range of opening speeds and resistance forces as desired for a particular door closer design 10.

When the door is released and to be closed, the door then moves the pistons in the direction of the closing stroke opposite of the arrows A so that the pistons 30 and 32 move towards their respective caps 38 and 39. This movement reduces the volume of the chambers 120 and 122 forcing hydraulic fluid therein to exit these chambers. The hydraulic fluid is prevented from flowing through the first ports 124 and 126 via closing of the ball check valve assembly 140. The fluid therein will therefore flow via the third ports 128 and 130 into the third lower passageway 116. The fluid will then flow through the closing speed valve 106 at a metered rate set by adjusting the tool head 108. The fluid will then flow into the upper first passageway 114 and can freely flow through the second ball check valve assembly 146 to the second lower passageway 118. The fluid can enter the interior chamber 119 through the opening 156. When clear of the pistons 30 and 32, the fluid can also flow through the second ports 132 and 134 into the interior chamber 119. The fluid will then flow through the closing speed valve 106 at a metered rate set by adjusting the tool head 108. The fluid will then flow into the upper first passageway 114 and can freely flow through the second ball check valve assembly 146 to the second lower passageway 118. The-fluid can enter the interior chamber 119 through the opening 156. When clear of the pistons 30 and 32, the fluid can also flow through the second ports 32 and 34 into the interior chamber 119.

As is known and described in U.S. Pat. No. 3,246,362, once the third ports 128 and 130 are closed off by the pistons 30 and 32, fluid can only exit the chambers 120 and 122 via the first ports 124,126, respectively. Since the first ball check valve assembly 140 prevents flow in the direction toward the closing speed valve 106, the fluid must pass through the latching speed valve 102 at a rate that can be set by adjusting the tool head 104 of the valve. Therefore, a slower latching speed as desired can be set that will prevent slamming of the door against the door frame.

Novelty of the present invention is in the positioning of the second ball check valve assembly 140 wherein the ball 142 is prevented from moving in one direction by its valve seat 144 and is retained in the other direction by the valve stem 154 of the valve assembly 102. Because of the placement of the valve stem 154, no additional components for the valve assembly 140 are required other than the ball and seat, thus reducing complexity and cost for such a valve.

Additional,novelty of the present invention is in the function and placement of the hydraulic backcheck valve 110, the first ball check valve assembly 146, and the second ports 132 and 134. These components of the system can control the resistance and speed of opening of the door 20. Prior door closers generally only permit adjustment of door closing speed and not control of opening speed or dual control of both opening and closing speed.

The first ball check valve assembly 146 is intended to be a full flow valve in one direction in order to prevent initial resistance to closing of the door and therefore door closing, even at the initial stage, is controlled solely by the closing speed valve 106 adjustment.

The particular arrangement of the valves and passageways can be varied from the presently described embodiment and still accomplish the goals of the present invention. The positioning and orientation of these valves and passageways can be reversed and altered significantly and yet still provide the hydraulic fluid flow characteristic necessary for controlling the opening and closing cycles of the door closer 10. The particular materials to fabricate the door closer 10 and the components thereof can also vary considerably and yet fall within the scope of the present invention. The particular valve types and constructions can also vary within the scope of the present invention.

Changes and modifications can be made to the embodiments disclosed herein. These changes and modifications are intended to fall within the scope of the present invention. Therefore, the scope of the present invention is intended to be limited only by the scope of the appended claims.

We claim:

1. A door closer having a fluid passage therein comprising:

a latch speed valve positioned in said fluid passage;

a closing speed valve positioned in said fluid passage; and a one-way check valve disposed within the fluid passage between the closing speed valve and the latching speed valve, the one-way check valve permitting fluid flow from the closing speed valve to the latching speed valve within the fluid passage and prohibiting fluid flow from the latching speed valve to the closing speed valve within the fluid passage.

2. The door closer according to claim 1, wherein the one-way check valve is a ball check valve having a valve seat and a ball, and wherein the ball is restrained in one direction of the fluid passage by the valve seat and in an opposite direction of the fluid passage by a valve stem of the latching speed valve.

3. A door closer defining a door opening and a door closing cycle, the door closer comprising:

a housing having an interior;

at least one cylinder within the housing;

at least one piston that can reciprocate between a door closing stroke and a door opening stroke within the at least one cylinder, the at least one piston dividing the interior into first and second chambers;

a fluid passage in fluid communication with the first chamber having a latch speed valve, a closing speed valve therein, and a one-way check valve disposed within the fluid passage between the closing speed valve and the latching speed valve, the one-way check valve permitting fluid flow from the closing speed valve to the latching speed valve within the fluid passage and prohibiting fluid flow from the latching speed valve to the closing speed valve within the fluid passage.

4. The door closer according to claim 3, wherein the one-way check valve is a ball check valve having a valve seat and a ball, and wherein the ball is restrained in one direction of the fluid passage by the valve seat and in an opposite direction of the fluid passage by a valve stem of the latching speed valve.

5. A door closer defining a door opening and a door closing cycle, the door closer comprising:

a housing having an interior;

at least one cylinder within the housing;

at least one piston that can reciprocate between a door closing stroke and a door opening stroke within the at least one cylinder, the at least one piston dividing the interior into first and second chambers;

a first passage having a first port providing fluid communication between the first passage and the first chamber and having a second port providing fluid communication with the at least one cylinder, wherein the second port is blocked by the at least one piston during at least part of the door opening stroke;

a second passage having an opening in fluid communication with the second chamber;

a third passage having a third port providing fluid communication between the third passage and the first chamber, the third port being disposed between the first and the second ports in the at least one cylinder, and wherein the third port is blocked by the at least one piston during at least part of the door closing stroke;

a latch speed valve providing metered fluid flow between the first and the third passages when the third port is blocked during the closing stroke;

a closing speed valve providing metered fluid flow between the first and the third passages when the third port is not blocked during the closing stroke;

a first one-way valve assembly in fluid communication with the first and the second passages, the one-way valve assembly permitting fluid flow from the first passage to the second passage and prohibiting fluid flow from the second passage to the first passage;

a second one-way check valve disposed within the first passage between the closing speed valve and the latching speed valve, the second one-way check valve permitting fluid flow from the closing speed valve to the latching speed valve within the first passage and prohibiting fluid flow from the latching speed valve to the closing speed valve within the first passage; and a backcheck valve providing metered fluid flow from the second passage to the first passage, and wherein fluid can bypass the backcheck valve through the second port of the first passage when the at least one piston does not block the second port during the door opening stroke of the opening cycle.

6. The door closer according to claim 5, further comprising:

a biasing mechanism for biasing the at least one piston in a direction of the door closing stroke.

7. The door closer according to claim 6, wherein the biasing mechanism is a spring.

8. The door closer according to claim 5, further comprising:

a pair of the cylinders within the housing;

a pair of the pistons, one of each received in a corresponding one of the cylinders; and a pair of the second ports, one of each providing fluid communication between the second passage and a corresponding one of the cylinders.

9. The door closer according to claim 5, wherein the first chamber is a variable volume chamber defined within the cylinder and faces one side of the at least one piston, and wherein the second chamber is an interior chamber of the housing and faces an opposite side of the at least one piston.

10. The door closer according to claim 5, wherein the second one-way check valve is a ball check valve having a valve seat and a ball, and wherein the ball is restrained in one direction of the first passage by the valve seat and in an opposite direction of the first passage by a valve stem of the latching speed valve.

11. The door closer according to claim 5, wherein the backcheck valve is a needle valve having a valve stem and a tool receiving head on one end of the valve stem for receiving a tool that can adjust the metered flow rate of the backcheck valve.

12. The door closer according to claim 11, wherein the tool receiving head of the backcheck valve is accessible from an exterior surface of the housing.

* * * * *